United States Patent [19]

McCall

[11] 4,173,536

[45] Nov. 6, 1979

[54] SURFACE FLUID COLLECTOR

[75] Inventor: Richard H. McCall, Houston, Tex.

[73] Assignee: Texaco Inc., White Plains, N.Y.

[21] Appl. No.: 864,168

[22] Filed: Dec. 27, 1977

[51] Int. Cl.[2] ..... E02B 15/04

[52] U.S. Cl. ..... 210/242 S; 210/513; 210/DIG. 25

[58] Field of Search ..... 210/83, 242 R, 242 AS, 210/242 S, 404, 513, 523, DIG. 25, DIG. 26

[56] References Cited

U.S. PATENT DOCUMENTS

| | | | |
|---|---|---|---|
| 1,573,085 | 2/1926 | Meiani | 210/DIG. 26 |
| 2,052,156 | 8/1936 | Young | 210/404 |
| 3,096,280 | 7/1963 | Davis et al. | 210/404 |
| 3,396,850 | 8/1968 | Kubat et al. | 210/520 X |
| 3,576,257 | 4/1971 | Yaks | 210/242 S |
| 3,613,891 | 10/1971 | Cloutier | 210/242 S |
| 3,700,108 | 10/1972 | Richards | 210/242 S |
| 3,762,558 | 10/1973 | Anderson | 210/242 S |
| 3,865,730 | 2/1975 | Ayers et al. | 210/242 S |

*Primary Examiner*—Robert H. Spitzer

*Attorney, Agent, or Firm*—Carl G. Ries; Thomas H. Whaley; Theron H. Nichols

[57] ABSTRACT

Apparatus for skimming surface fluid off of a main fluid including a floating collection housing adapted to float in such main fluid and a rotating skimming wheel having an annular skimming chamber including a plurality of compartments, each compartment being opened by a gravity actuated valve for skimming surface fluid off of the main fluid when such compartment is rotated into the main fluid so that the surface fluid is skimmed from the main fluid into such compartment, the compartment being subsequently emptied into the floating collection housing after rotation out of the main fluid. The buoyancy of the apparatus is adjustable to control the position of the compartments during skimming operations with respect to the interface between the surface and main fluids.

10 Claims, 4 Drawing Figures

22b
4
16

C
10c
10
19a
17
42b
19
10a
10f
47
22
2
2
42
47a
18
10e
42a
18a
14
40
10b
10d
32
15
3
3
22a
36a
4

43d 43b
43c
52
51
50
47
43a
10f
47a
10d
10g
45c
46b
44a
46a
45a
45b
10e
45d
45
10a

SURFACE FLUID COLLECTOR

BACKGROUND OF THE INVENTION

The field of this invention relates to the skimming of a surface fluid from a main fluid and in particular to the skimming of oil from the surface of a body of water.

During the past several years, the environmental evils of oil spills have become well known. Oil spilled into the ocean spreads to cover a large area and may do significant environmental harm to the body of water itself and further, even more vivid harm to a shoreline if the spill area washes in.

However, oil may very well be the most precious commodity being produced at this time. Without oil, the United States would be virtually helpless. Presently, oil is available from foreign countries in whatever quantities are needed, but at exorbitant prices, prices which tend to disrupt the balance of payments and intensify the inflationary spiral. It is therefore necessary for the United States to continue to develop its own oil reserves off its shores, despite the risk to the environment of oil slicks caused by spills, well blowouts and the like. One answer lies in developing equipment which will remove spilled oil from the surface of the water as quickly and efficiently as possible. The only prior art known to the Applicant at this time is U.S. Pat. No. 3,396,850, which is actually directed to a process for separation and fractionation wherein rotation is utilized in part to accomplish these goals.

SUMMARY OF THE INVENTION

The skimming device of this invention includes a floating collection housing or barge having mounted therewith a rotating skimming means for rotation with respect to the collection housing into a main fluid such as the ocean having a surface fluid such as spilled oil floating thereon. The rotating skimming means is provided for skimming the surface fluid off of the main fluid into the rotating skimming means and for transferring the skimmed fluid into the floating collection housing after rotation of the rotating skimming means out of the main fluid.

In the preferred embodiment of this invention, the rotating skimming means includes an annular skimming chamber mounted for rotation onto the floating collection housing by a rotation mount means. The annular skimming chamber is formed of a plurality of compartments, which are rotated into and out of the main fluid. Each compartment has a valve means for opening the compartment to receive surface fluid when the compartment is rotated into the main fluid. The collected, skimmed fluid is then transferred out of the compartment after the compartment has been rotated out of the main fluid. This description of the invention set forth herein is intended as a summary only, the claims attached herewith represent the scope of patent protection sought.

DESCRIPTION OF THE PREFERRED EMBODIMENT

Figure 1:
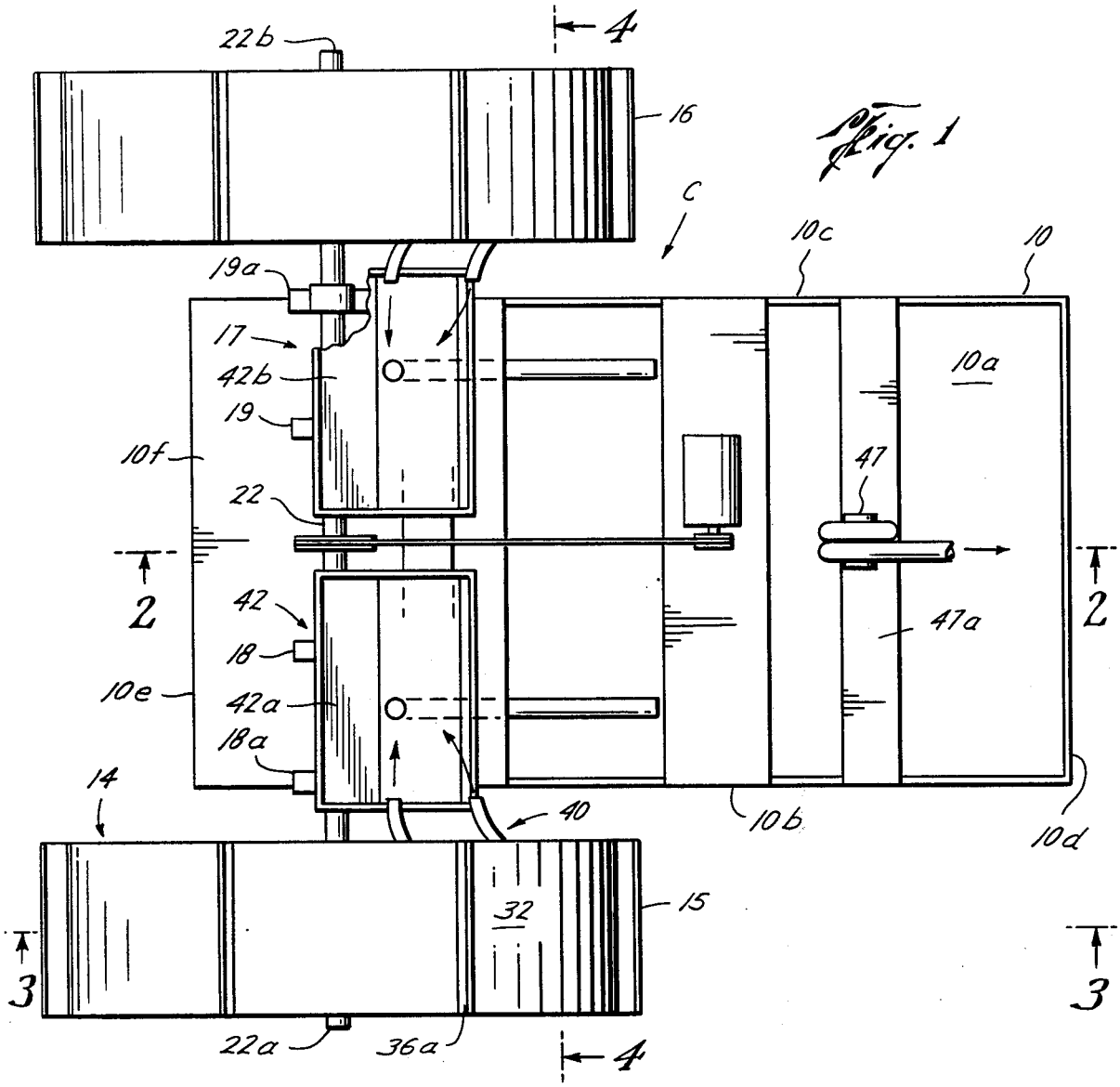
FIG. 1 is a top view of the surface fluid collector of the preferred embodiment of this invention.

Referring to the drawings, the letter C generally designates the surface fluid collector of the preferred embodiment of this invention. The surface fluid collector C includes a floating collection housing or barge generally designated by the number 10. The barge 10 includes a flat bottom **10*a* and vertical sides 10*b* and 10*c*. Front barge end 10*d* and rear barge end 10*e* are both inclined outwardly from bottom 10*a* and cooperate with sides 10*b* and 10*c* to form the barge sides. The floating collection housing is adapted to float in the main fluid such as a body of water which is identified by the number 11. The main fluid has a surface fluid 12 floating thereon, the surface fluid being spilled oil by way of example. The main fluid 11 and surface fluid 12** may be fluids other than a body of water and surface oil; therefore, the scope and application of this invention is not limited to the removal of surface oil from water.

Rotating skimming means generally designated by the number 14 is mounted onto the following collection housing 10 for rotation into the main fluid 11 and surface fluid 12 for skimming the surface fluid 12 off of the main fluid 11 and for transferring such skimmed fluid into the floating collection housing 10 after rotation out of such main fluid. The term "skimming" as used herein means separating the surface fluid 12 from the main fluid 11 by providing for the gravity flow of such surface fluid into said rotating skimming means 14. Rotating skimming means 14 includes two rotating wheel collectors generally designated by the numbers 15 and 16. A rotation mount means generally designated by the number 17 mounts the two rotating wheel collectors 15 and 16 for rotatable movement in substantially vertical planes.

The rotation mount means 17 includes V-shaped stanchions 18 and 19 (FIGS. 1 and 4) which are mounted onto platform or deck 10f (FIG. 3) on the floating collection housing 10; and each stanchion includes legs which converge into bearing housings **18*a* and 19*a*, respectively (FIGS. 1 and 4), which support shaft 22. Referring to FIG. 1, the shaft 22 includes end portions 22*a* and 22*b* that extend cantilevered outwardly from housing sides 10*b* and 10*c*, respectively. The rotating wheel collectors 15 and 16 are each mounted at the extended shaft ends 22*a* and 22*b***, respectively.

The rotating wheel collectors 15 and 16 are allochiral analogs or mirror images of each other; therefore, only the rotating wheel collector 15 will be described in detail, it being understood that the actual number of rotating wheel collectors may actually be more or less than the two rotating wheel collectors 15 and 16 illustrated.

The rotating wheel collector 15 includes two wheel frame support units **23*a* and 23*b* (FIG. 4), each wheel frame support including a circular frame member 24*a* (FIG. 3) attached to spokes 24*b*, 24*c* and 24*d* which converge to a common hub 24*e*, the hub 24*e* receiving the shaft 22**.

Figure 3:
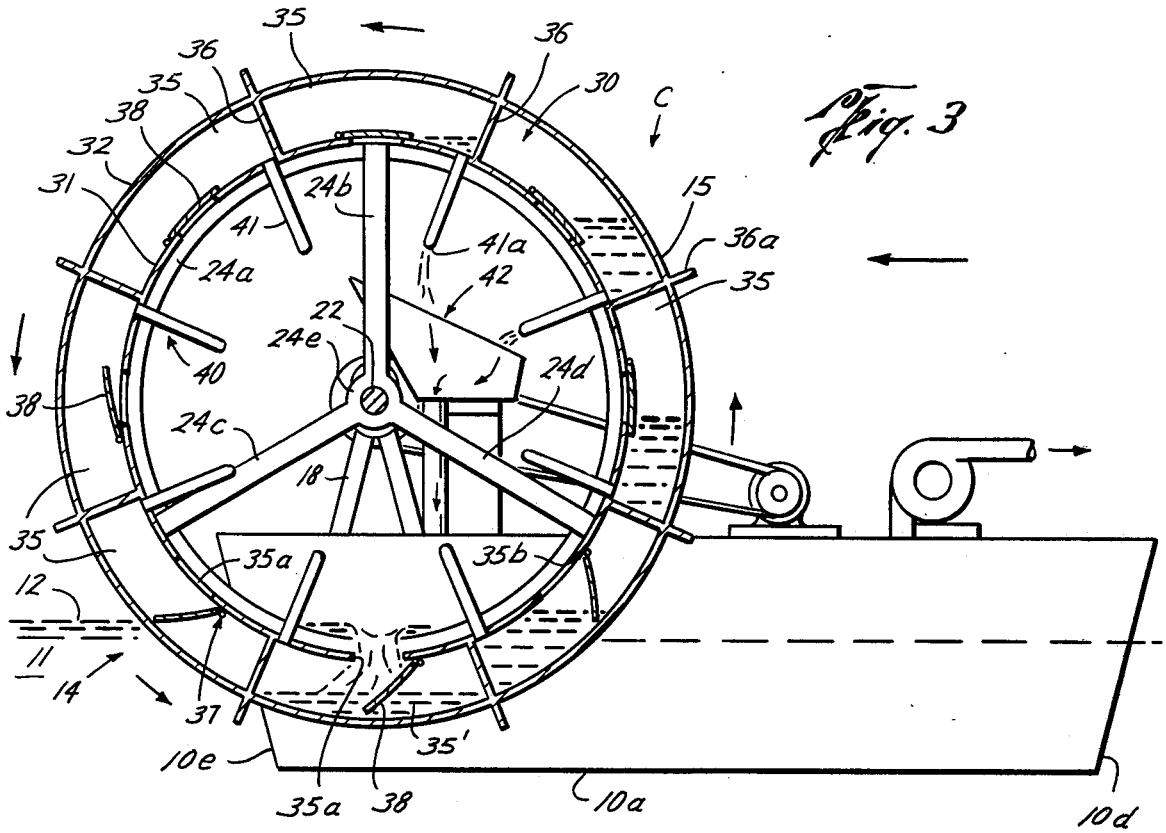
FIG. 3 is a sectional, side view taken along line 3—3 of FIG. 1.
Figure 4:
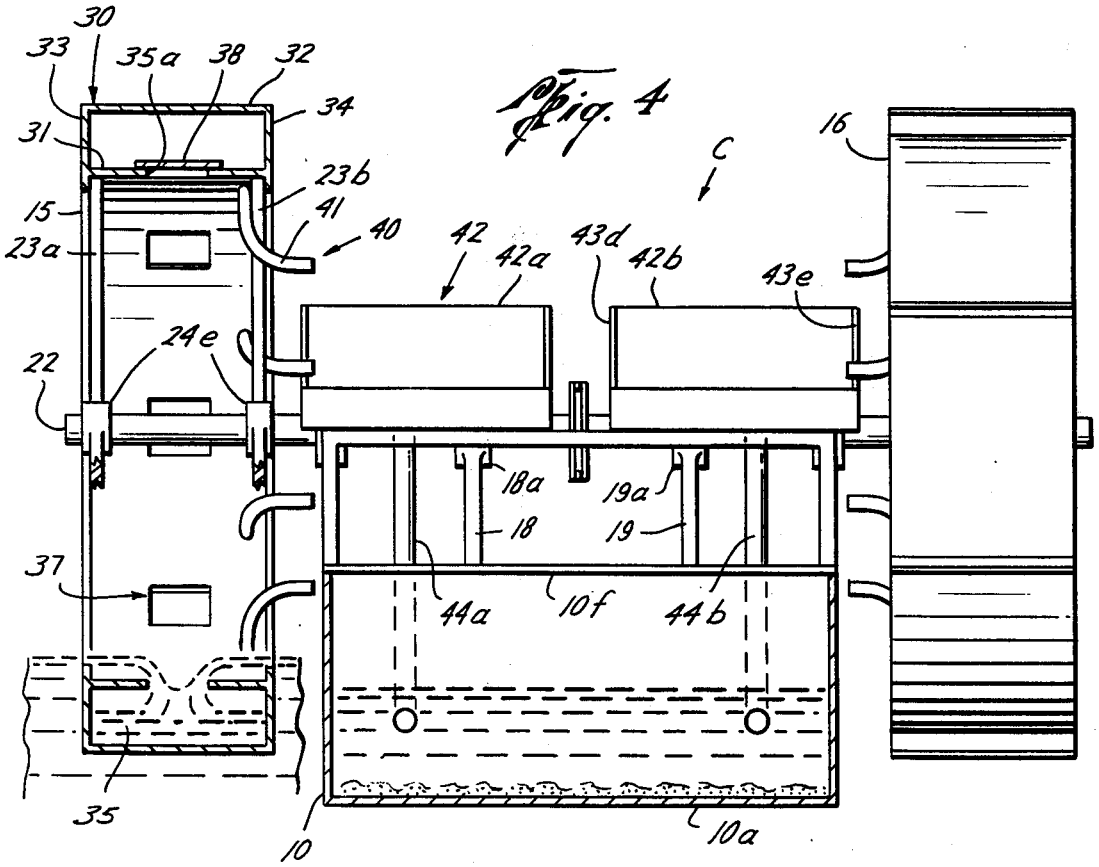
FIG. 4 is a front view in section taken along line 4—4 of FIG. 1 with some parts in section to clarify the disclosure of the surface collector apparatus.

Referring in particular to FIGS. 3 and 4, the rotating wheel collector 15 further includes an annular skimming chamber generally designated by the number 30 which is mounted onto the circular frame support units **23*a* and 23*b* for rotation therewith. The annular skimming chamber 30 is formed of an inner circular wall 31 which is spaced from an outer circular wall 32, the radial distance or height between the two walls of the annular skimming chamber forming the radial depth of the annular skimming chamber, the walls 31 and 32 being interconnected by circular side panels 33 and 34 the length of the side panels forming the length of the annular skimming chamber, all of which which cooperate to form the annular skimming chamber 30** having a square or rectangular cross section through any radial plane.

Referring in particular to FIGS. 3 and 4, the annular skimming chamber 30 includes a plurality of circumferentially spaced compartments 35 formed by radially directed partitions 36 which are circumferentially spaced about the annular skimming chamber 30, the distance between two consecutive partitions 36 determining the length of the annular skimming chamber. In the embodiment illustrated, the number of circumferentially spaced skimming compartments 35 is eight. The actual number of compartments 35 may be varied as conditions require. Each skimming compartment 35 includes an opening **35*a* having a skim valve means generally designated by the number 38 mounted on pivot 37 therein to control access to the skimming compartment 35**.

Referring to FIGS. 3 and 4, each skim valve means 38 is gravity actuated and includes a hinged valve member 38 which is hinged at the right or leading edge **35*b* of the opening 35*a* in the circular, inner chamber wall 31 with hinge 37. The edge 35*b* is described as being the leading edge due to counterclockwise rotation of wheel 15 as viewed in FIG. 3. The hinged valve member 38 is positioned to be opened under the influence of gravity during circular travel of the chamber 35 from counterclockwise travel from the top to the bottom of the circular path through which the compartment 35 is rotated. As the circular compartment 35 rotates in such counterclockwise direction from the top to the bottom of its circular path, the hinged valve member will open under the influence of gravity to the position illustrated in the lowermost compartment in FIG. 3, such lowermost compartment being identified by the number 35'. When the lowermost compartment 35' is so positioned, the opening 35*a* in the inside wall 31 is positioned substantially at the interface between the surface fluid 12 and main fluid 11 so that the surface fluid will flow by gravity into the opening 35*a*. As the lowermost compartment 35' is then moved counterclockwise from the lowermost point to the uppermost point in its counterclockwise path, the influence of gravity will close the hinged valve member 38 to prevent the skimmed surface fluid from escaping. Referring to FIG. 3, the hinged or skim valve member 38 for each compartment 35 is open as each compartment 35 is rotated into the main fluid 11 and is closed after the compartment is rotated out of the main fluid 11 after collecting surface fluid 12**.

Figure 2:
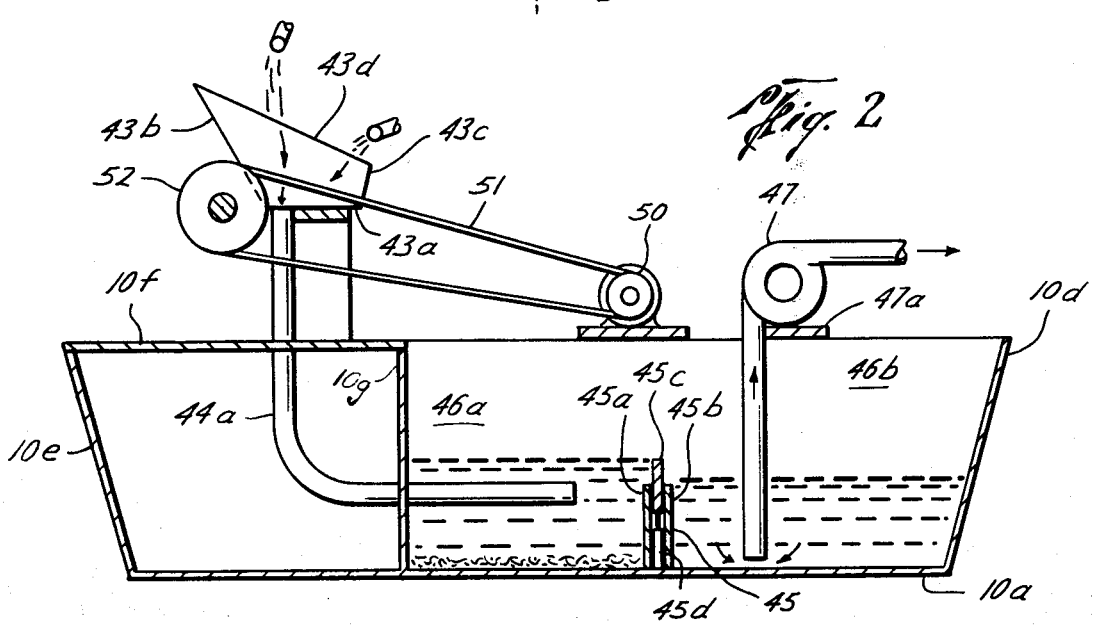
FIG. 2 is a side view in section taken along line 2—2 of FIG. 1 illustrating the details of the floating collection housing with the rotating collector removed.

Referring to FIGS. 1, 3 and 4, tubular transfer means generally designated by the number 40 is mounted with each compartment 35 to allow the flow of such collected skimmed surface fluid 12 (and any incidentally collected main fluid 11) out of the partially or completely filled compartments 35 as such compartments are rotated counterclockwise upwardly from the lowermost position toward the uppermost position. The tubular transfer means 40 includes a tubular member 41 which is mounted in the inside wall 31 of each compartment 35 and extends radially inwardly as viewed in FIG. 3 and transversely inwardly in a approximately L-shaped configuration as viewed in FIGS. 1 and 4. Each tubular member 41 terminates in open end **41*a* (FIG. 3) which is vertically positioned over a skim fluid transfer means 42 comprising gathering troughs 42*a* and 42*b* (FIGS. 1 and 4) when such tubular member 41 becomes positioned at a downwardly facing incline so that gravity will cause the collected skim surface fluid 12 and incidentally collected main fluid 11 to pour outwardly of the compartments 35 into troughs 42*a* and 42*b*. Referring to FIG. 2, each gathering trough 42*a* and 42*b* includes a flat bottom portion 43*a* and inclined sides 43*b* and 43*c* which incline outwardly from bottom 43*a*. End members 43*d* and 43*e* form the gathering troughs 42*a* and 42*b* into open troughs having sufficient distance between the top edges of side members 43*b* and 43*c* to be positioned vertically under two tubular transfer members 41 positioned in adjacent emptying compartments 35** for sufficient time to complete the emptying of the leading compartment and begin the emptying of the next following compartment.

Referring to FIGS. 2 and 4, two substantially L-shaped drain tubes **44*a* and 44*b* extend downwardly from the bottoms 43*a* of troughs 42*a* and 42*b* into the interior of floating collection housing 10 through wall 10*g* into chamber 46*a*. Referring to FIG. 2, an adjustable weir or wall assembly 45 is mounted forward of the rotating wheel collectors 15 and 16 for dividing the interior of the floating collection housing 10 into the first and second barge collection chambers 46*a* and 46*b*. The weir assembly 45 is adjustable in order to control the fluid level at which collected surface fluid 12 flows from collection interior chamber 46*a* into the transfer chamber 46*b*. In FIG. 2, the weir assembly 45 includes a vertically adjustable center section including side plates 45*a* and 45*b* which slidably mount a center gate member 45*c*. The vertical position of the center gate member 45*c* is controlled by hydraulic cylinder assembly 45*d* (the remainder of such hydraulic controls being well known in the art) so that the weir assembly can be remotely controlled. The weir assembly 45 also allows for the settlement of solids. The purpose of the adjustable weir 45 is to provide a means for controlling or adjusting the buoyancy of the entire surface fluid collector C so that the relative vertical position of the compartment openings 35*a* at the lowest, skimming position of chamber 35' may be adjusted with respect to the interface of the surface fluid 12 with main fluid 11**.

A pump 47 is mounted onto a top plate **47*a* of the floating collection housing 10** for pumping the collected, skimmed surface fluid to any desirable storage area or vessel.

Referring to FIG. 3, each radially directed partition 36 includes an outwardly extending end portion **36*a* which serves as a vane for propelling the entire surface fluid collector C as desired. A suitable drive means for rotating the wheel collectors 15 and 16 includes a drive motor 50 which operably engages through drive belt or chain 51 a pulley or gear 52 mounted onto the shaft 22**. Any suitable type of motor and drive assembly may be utilized within the scope of this invention. In addition, propulsion means may be mounted on the floating collection housing itself if desired.

The foregoing disclosure and description of the invention are illustrative and explanatory thereof, and various changes in the size, shape and materials as well as in the details of the illustrated construction may be made without departing from the spirit of the invention. As previously mentioned, the exact number of rotating collection wheels 15 and 16 may be varied as desired. In addition, it is within the scope of this invention to utilize the surface fluid collector C to skim various types of surface fluid 11 off of a main fluid 12.

I claim:

1. Apparatus for skimming a surface fluid from a main fluid, comprising:

a collection housing means having an annular skimming chamber; and said rotating annular skimming chamber having a skim valve means, said skim valve means opening when said chamber is rotated into such surface and main fluids and closing after such chamber is rotated out of such fluids.

2. An apparatus for skimming a surface fluid, comprising;

a floating collection housing adapted to float in a main fluid having such surface fluid located on the surface of such main fluid;

rotating skimming means, said rotating skimming means including rotation mount means for mounting an annular skimming chamber on said collection housing for rotation with respect to said collection housing into such surface and main fluids for skimming such surface fluid off of said main fluid into said rotating skimming means and for transferring such skimmed fluid into said collection housing after rotation out of such main fluid, said annular skimming chamber comprising a plurality of skim compartments for skimming the surface fluid and collecting same in said compartments, wherein each compartment includes skim valve means;

said rotation mount means rotating said skim compartments into and out of such surface and main fluids; and said skim valve means for each compartment opening when its compartment is rotated into such surface and main fluids and closing after each such compartment is rotated out of such surface and main fluids.

3. The structure set forth in claim 2, including:

each such skim valve means being gravity actuated.

4. The structure set forth in claim 2, wherein said rotating skimming means includes:

skimmed fluid transfer means for transferring skimmed surface fluid from said compartments to said floating collection housing.

5. The structure set forth in claim 4, wherein said skimmed fluid transfer means includes:

a gathering trough mounted onto said rotation mount means for receiving skimmed fluid from said compartments and transferring such skimmed fluid to said floating collection housing.

6. The structure set forth in claim 5, including:

tubular means mounted with each compartment for positioning above said gathering trough for gravity transfer of said skimmed fluid from said compartment to said trough during rotating of skim compartment out of such main and surface fluids.

7. An apparatus for skimming a surface fluid from a main fluid comprising, a collection housing means having an annular skimming chamber, said annular skimming chamber having a skim valve means, said skim valve means opening when said chamber is rotated into such surface and main fluids and closing after such chamber is rotated out of such fluids, and skimmed fluid transfer means for transferring skimmed surface fluid from said annular skimming chamber to said floating collection housing, and said skim valve means comprising pivotal valve means on an inlet of said annular skimming chamber, said pivotal valve means being pivoted open when submerged for insuring flow of the surface fluid into said skimming chamber, and said pivotal valve means being pivoted closed when above the surface fluid level for preventing exit flow of the surface fluid therethrough.

8. An apparatus for skimming a surface fluid from a main fluid comprising, a collection housing means having an annular skimming chamber, said annular skimming chamber having a skim valve means, said skim valve means opening when said chamber is rotated into such surface and main fluids and closing after such chamber is rotated out of such fluids, and buoyancy adjustment means for said collection housing means for adjusting the position of said rotating skimming means to the depth of the radial height of said annular skimming chamber plus the depth of the surface fluid.

9. Apparatus for skimming a surface fluid off of a main fluid, comprising:

an annular skimming chamber on a float;

rotation mount means mounting said annular skimming chamber for rotation on said float;

said annular skimming chamber including a plurality of circumferentially skim compartments which are rotated into and out of such surface and main fluids by said rotation mount means; and each compartment having a skim valve means for opening such compartment at the interface between such surface and main fluids in order to allow surface fluid to flow into said compartment and for closing said compartment after rotation out of such surface and main fluids for then flowing out of said compartment into a collection housing on said float.

10. An apparatus for skimming a surface fluid from a main fluid comprising, a floating collection housing means having a rotatable annular skimming chamber mounted thereon, said rotatable annular skimming chamber having a skim valve means, said valve means opening when said chamber is rotated into such surface and main fluids and closing after such chamber is rotated out of the fluids.

* * * * *